US009017625B2

(12) United States Patent
Van Vuuren et al.

(10) Patent No.: US 9,017,625 B2
(45) Date of Patent: Apr. 28, 2015

(54) UPGRADING OF TITANIFEROUS MATERIAL

(75) Inventors: David Steyn Van Vuuren, Pretoria (ZA); Jaco Johannes Swanepoel, Pretoria (ZA)

(73) Assignee: CSIR, Pretoria (ZA)

( * ) Notice: Subject to any disclaimer, the term of this patent is extended or adjusted under 35 U.S.C. 154(b) by 8 days.

(21) Appl. No.: 13/993,305

(22) PCT Filed: Nov. 24, 2011

(86) PCT No.: PCT/IB2011/055275

§ 371 (c)(1),
(2), (4) Date: Jun. 11, 2013

(87) PCT Pub. No.: WO2012/080875

PCT Pub. Date: Jun. 21, 2012

(65) Prior Publication Data

US 2013/0266494 A1 Oct. 10, 2013

(30) Foreign Application Priority Data

Dec. 13, 2010 (ZA) ..... 2010/08970

(51) Int. Cl.
*C22B 34/00* (2006.01)
*C22B 34/12* (2006.01)

(52) U.S. Cl.
CPC ..... *C22B 34/1259* (2013.01); *C22B 34/12* (2013.01); *C22B 34/1245* (2013.01)

(58) Field of Classification Search
None
See application file for complete search history.

(56) References Cited

U.S. PATENT DOCUMENTS 1,343,441 A 6/1920 Peder Farup
5,224,986 A 7/1993 Mostert et al.
6,629,838 B1 * 10/2003 Van Vuuren et al. ..... 432/148

FOREIGN PATENT DOCUMENTS

SU 353992 A1 10/1972

OTHER PUBLICATIONS

Translation of SU 353992, (Petrunko et al.), Oct. 9, 1972.*
Patent Cooperation Treaty, International Searching Authority, Search Report and Written Opinion for PCT/IB2011/055275, 9 pages, Mar. 16, 2012.
Chen, "Mechanically enhanced carbothermic synthesis of iron-TiN composite", Journal of Materials Science Letters, vol. 16 (1), 37-39 (1997).

* cited by examiner

*Primary Examiner* — Steven Bos
(74) *Attorney, Agent, or Firm* — Viksnins Harris & Padys PLLP

(57) ABSTRACT

A method of upgrading a titaniferous material includes nitriding and reducing a titaniferous material which includes $TiO_2$ and Fe oxides in the presence of nitrogen and carbon to convert the $TiO_2$ to TiN and to reduce most of the Fe oxides to Fe. The Fe is oxidized in preference to the TiN to form $Fe^{2+}$ ions, whereafter the $Fe^{2+}$ ions are removed to produce an upgraded low-Fe TiN bearing material.

13 Claims, 2 Drawing Sheets

UPGRADING OF TITANIFEROUS MATERIAL

RELATED APPLICATIONS

Figure 1:
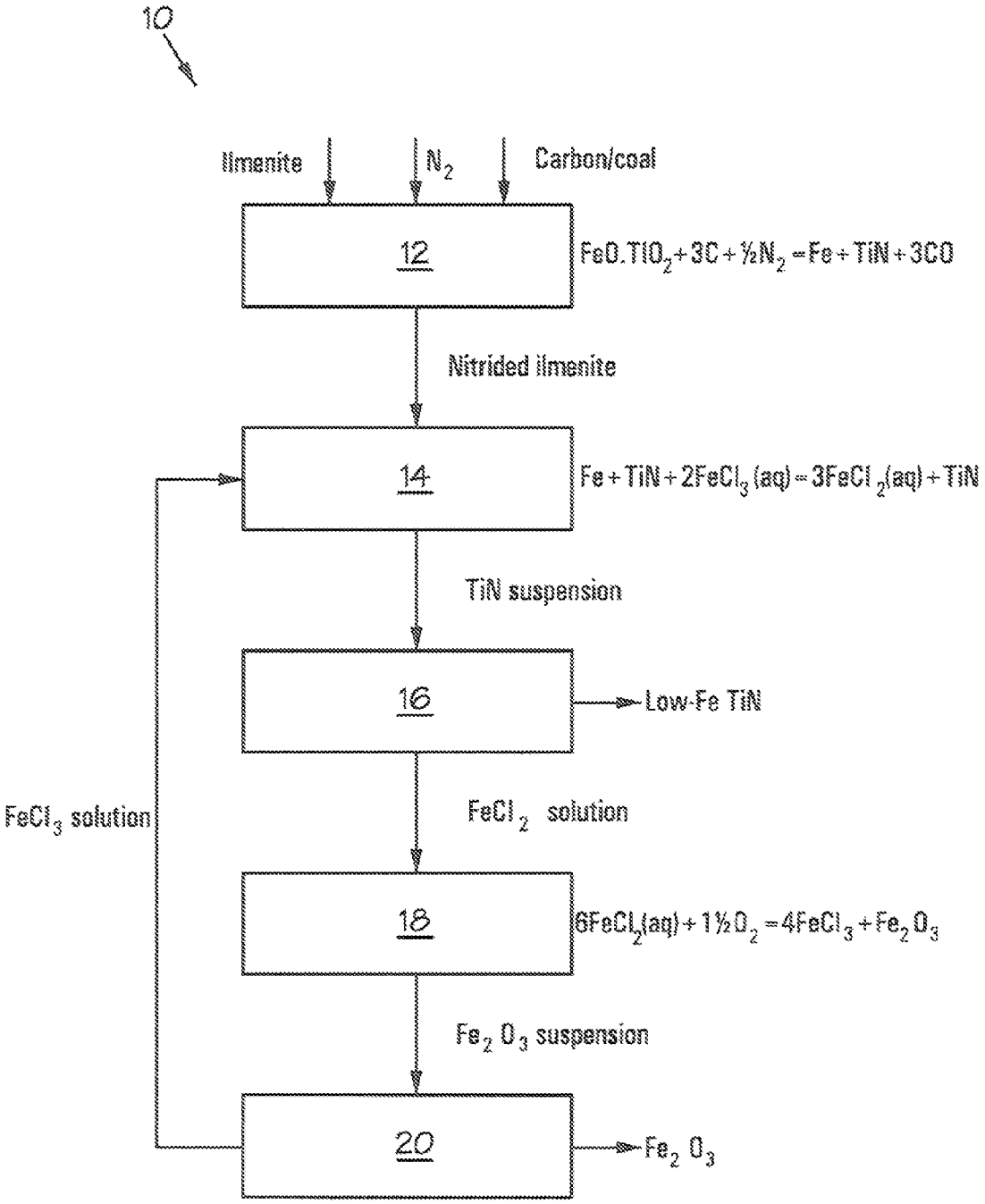

This application claims priority to South African Patent Application Number 2010/08970 that was filed on Dec. 13, 2010.

THIS INVENTION relates to the upgrading of titaniferous material. In particular, the invention relates to a method of upgrading a titaniferous material.

Conventional processes, and in particular conventional commercial processes, to produce $TiCl_4$ use titaniferous raw materials with a high content of $TiO_2$. The $TiO_2$ is reacted with chlorine in a high temperature chlorinator (about 900° C.) to produce $TiCl_4$, which is used commercially on large-scale to produce $TiO_2$ pigment or titanium metal. Unfortunately, chlorine reacts unselectively at high temperatures, with chlorine thus being consumed by other constituents of the titaniferous raw materials.

A method of upgrading titaniferous materials, such as ilmenite, to a form which consumes less chlorine or produce less chloride wastes from impurities in the titaniferous feed material and which can produce $TiCl_4$ in a process step conducted at a lower temperature would be desirable. It would also be advantageous if such a method is more economical and can upgrade low-grade titaniferous materials, such as low-grade titanium-bearing slag.

According to the invention, there is provided a method of upgrading a titaniferous material, the method including nitriding and reducing a titaniferous material which includes $TiO_2$ and Fe oxides in the presence of nitrogen and carbon to convert the $TiO_2$ to TiN and to reduce most of the Fe oxides to Fe;

oxidising the Fe in preference to the TiN to form $Fe^{2+}$ ions; and removing the $Fe^{2+}$ ions to produce an upgraded low-Fe TiN bearing material.

Typically, the upgraded low-Fe TiN bearing material is an admixture of TiO, TiN and TiC.

A plurality of Fe oxides, e.g. $Fe^{2+}$ and $Fe^{3+}$ will thus be present in the titaniferous material. The Fe oxides in the titaniferous material are thus carbothermically reduced to Fe while the $TiO_2$ in the titaniferous material is nitrided to TiN. Advantageously, the TiN is more reactive than $TiO_2$, and chlorine, other than with Fe, reacts selectively with TiN at much lower temperatures than with $TiO_2$, e.g. about 170° C.-250° C., to form $TiCl_4$ with virtually no waste chlorides, except $FeCl_2$ and/or $FeCl_3$, being formed.

The method may thus include chlorinating the upgraded low-Fe TiN bearing material thereby converting the TiN therein to $TiCl_4$. The chemical reaction involved is in accordance with reaction (1):

$$TiN+2Cl_2=TiCl_4+\tfrac{1}{2}N_2 \quad (1)$$

As most, if not substantially all of the Fe, as $Fe^{2+}$ ions, has been removed to provide the low-Fe TiN bearing material, chlorinating the TiN will lead to little chlorine being consumed by iron, thus advantageously improving the economics of the method of the invention.

The chlorination of TiN is selective regarding the bulk of impurities that may be found in the low-Fe TiN bearing material, such as $SiO_2$, CaO, $Al_2O_3$ and MgO. These compounds do not react with chlorine at the low temperatures, i.e. about 170° C.-250° C., where TiN reacts with chlorine ($Cl_2$).

Nitriding and reducing a titaniferous material which includes $TiO_2$ and Fe oxides in the presence of carbon and nitrogen to convert the $TiO_2$ to TiN and to reduce the Fe oxides to Fe may be effected by any method known to those skilled in the art, such as the method described in U.S. Pat. No. 6,629,838. Typically, a large nitriding kiln is used to effect the nitriding and reduction, producing a carbo-nitrided intermediate which includes TiN and Fe. As will be appreciated, a source of nitrogen is required for this method step. Advantageously, if an air separation plant or facility is present to produce oxygen for downstream processing, nitrogen from the air separation plant may be used for nitriding purposes. The chemical reaction for the nitriding of $TiO_2$ is as follows, i.e. reaction (2):

$$TiO_2+2C+\tfrac{1}{2}N_2=TiN+2CO \quad (2)$$

When the $TiO_2$ is however mostly present as $FeO.TiO_2$, as in the case of ilmenite, which is the most abundant commercial mineral currently used for the extraction of titanium values, the $FeO.TiO_2$ may thus be nitrided carbothermically to provide TiN and metallic Fe and one or more carbon oxides (i.e. CO and/or $CO_2$). The nitriding and reducing reaction for the $FeO.TiO_2$ can in simplified form be described as follows, i.e. reaction (3):

$$FeO.TiO_2+3C+\tfrac{1}{2}N_2=Fe+TiN+3CO. \quad (3)$$

In a more complex form, the nitriding and reducing reaction for the $FeO.TiO_2$ can for example be described by way of exemplary reaction (3a):

$$FeO.TiO_2+2.8C+\tfrac{1}{2}N_2=Fe+TiN+2.6CO+0.2CO_2. \quad (3a)$$

Oxidising the Fe in preference to the TiN to form $Fe^{2+}$ ions may thus include reacting a carbo-nitrided intermediate which includes TiN and Fe with an oxidising anion to convert the Fe to $Fe^{2+}$. Typically, the oxidising anion is in the form of an aqueous salt solution.

The aqueous salt solution may be a chloride solution, preferably a $FeCl_3$ solution. Advantageously, both $FeCl_3$ and $FeCl_2$ have a high solubility in water. It is however to be appreciated that there are other salts, e.g. nitrates, that are also suitable for use in the method of the invention. For an efficient and economic process, the ferric ions must be in the form of a water-soluble salt and the corresponding ferrous salt must also be water-soluble, allowing water leaching of the ferrous salt from the carbo-nitrided intermediate.

When $FeCl_3$ is used as the aqueous salt solution, the following reaction, i.e. reaction (4), describes the oxidation of the Fe in preference to TiN to form $Fe^{2+}$ ions:

$$Fe+TiN+2FeCl_3(aq)=3FeCl_2(aq)+TiN \quad (4)$$

This reaction may conveniently be carried out at ambient temperature, but higher temperatures up to the boiling point of the ferric chloride solution enhance the rate of reaction between the $Fe^{3+}$ ions and the Fe and also increase the solubility of both ferric chloride and ferrous chloride.

Preferably, during nitriding and reducing of the titaniferous material, substantially all of the Fe oxides are reduced to metallic iron and not only to the divalent form. This is typically the case in any event at the highly reducing conditions at about 1300° C. used to nitride the $TiO_2$ to produce TiN. Typically, the iron is in the form of small particles that are intimately mixed with small TiN particles that are sintered together with a remainder of the titaniferous material, i.e. a carbo-nitrided intermediate which includes TiN and Fe. This advantageously allows extraction of the iron as $Fe^{2+}$ using $FeCl_3$ (ferric chloride) in accordance with reaction (4) above, instead of using hydrochloric acid. No hydrogen is thus formed, unlike the case with extraction by hydrochloric acid in accordance with reaction (5):

$$Fe+2HCl=FeCl_2+H_2 \quad (5)$$

thereby avoiding the dangers of hydrogen formation and problems caused by foaming. Furthermore, the reaction of $FeCl_3$ is rapid compared to processes where FeO is leached with HCl, making it possible to use shorter residence times and smaller reactors. In addition, the oxidation of aqueous ferrous chloride by oxygen, i.e. air, to regenerate $FeCl_3$ requires much less energy. Advantageously, the ferrous chloride ($FeCl_2$) can be oxidised (for purposes of recycling $Fe^{3+}$ and for purposes of removing an iron oxide by-product) in a separate reactor to a reactor in which the Fe is oxidised to form $Fe^{2+}$ ions, providing better separation of iron from TiN and providing the opportunity to select operating conditions to stimulate the growth of large iron oxide crystals, which is advantageous for the subsequent use or disposal of the iron oxides. As will also be appreciated, where HCl is used to leach iron species from TiN, provision has to be made to contain and scrub HCl vapours. In contrast, the vapour pressure of HCl over ferric chloride solutions ($FeCl_3$ solutions) is orders of magnitude less than over HCl solutions, thus allowing a much simplified mechanical construction of a plant to employ the method of the invention.

Surprisingly, TiN is remarkably resistant against attack by $FeCl_3$. The inventors have surprisingly found that, even though there is a large change in Gibbs free energy for the reaction, i.e. reaction (6):

$$8FeCl_3+2TiN+4H_2O=8FeCl_2+2TiO_2+8HCl+N_2\Delta G_{25}^{\circ}\ C.=-722kJ \quad (6)$$

and even though one would expect the very fine TiN particles formed by carbo-nitriding of titaniferous material such as ilmenite to be highly reactive as a result of their high surface to volume ratio, the oxidation of fine iron particles in nitrided ilmenite by aqueous ferric ions ($Fe^{3+}$) according to reaction (4) above is much faster than the oxidation of TiN particles by the $Fe^{3+}$ ions according to reaction (6) above. Advantageously, metallic iron in nitrided titaniferous material, such as ilmenite, can thus be converted to $Fe^{2+}$ ions and leached from TiN, with an aqueous solution of a suitable $Fe^{3+}$ containing salt.

Removing the $Fe^{2+}$ ions to produce an upgraded low-Fe TiN bearing material typically includes separation of $Fe^{2+}$ solution from the unreacted carbo-nitrided intermediate to produce the low-Fe TiN bearing material and a $Fe^{2+}$ solution. The separation may be effected by a physical separation step, e.g. filtration, settling or centrifuging. If required or desirable, the method may include washing the low-Fe TiN bearing material with an aqueous fluid. Preferably, the low-Fe TiN bearing material is dried before it is chlorinated.

As intimated hereinbefore, the method of the invention may include the step of regenerating $Fe^{3+}$ ions from the $FeCl_2$(aq) obtained by the leaching of the carbo-nitrided intermediate with $FeCl_3$(aq).

Typically, only a portion (e.g. about two-thirds) of the $FeCl_2$ is converted to $Fe^{3+}$ ions, the balance being in the form of a by-product of the method of the invention containing iron in a non-chloride form. The regenerated $Fe^{3+}$ ions may be recycled to oxidise the Fe in preference to the TiN to form $Fe^{2+}$ ions.

Regeneration of the $Fe^{3+}$ ions may include oxidation of the $FeCl_2$ with oxygen (typically air at about 1 to 2 bar(g) and 90° C.), e.g. according to reactions (7) and (8):

$$6FeCl_2(aq)+1\tfrac{1}{2}O_2=4FeCl_3(aq)+Fe_2O_3 \quad (7)$$

$$6FeCl_2(aq)+1\tfrac{1}{2}O_2+H_2O=2FeO.OH+4FeCl_3(aq) \quad (8)$$

Depending on reaction conditions, $Fe_3O_4$ can also precipitate.

Instead, regeneration of the $Fe^{3+}$ ions may include the electrochemical oxidation of the $FeCl_2$ in a cell to produce $FeCl_3$ at an anode of the cell and electrolytic iron at a cathode of the cell. The electrochemical reactions to regenerate ferric chloride and to electrowin iron are as follows, i.e. reactions (9), (10) and (11):

$$\text{cathode reaction } Fe^{2+}+2e^{-}=Fe \quad (9)$$

$$\text{anode reaction } 2Fe^{2+}=2Fe^{3+}+2e^{-} \quad (10)$$

$$\text{overall electrochemical reaction } 3Fe^{2+}=Fe+2Fe^{3+} \quad (11)$$

The titaniferous material may be ilmenite, as hereinbefore indicated. Instead, it may be a low-grade slag, e.g. a low-grade slag such as that produced by Highveld Steel and Vanadium Corporation in South Africa or by New Zealand Steel in New Zealand, containing about 30% $TiO_2$ and 5% Fe. The titaniferous material may also be a sulphate grade slag for example as produced by Exxaro Limited and Richards Bay Minerals, both of South Africa, which contains about 80% $TiO_2$ and 10% FeO.

Figure 2:
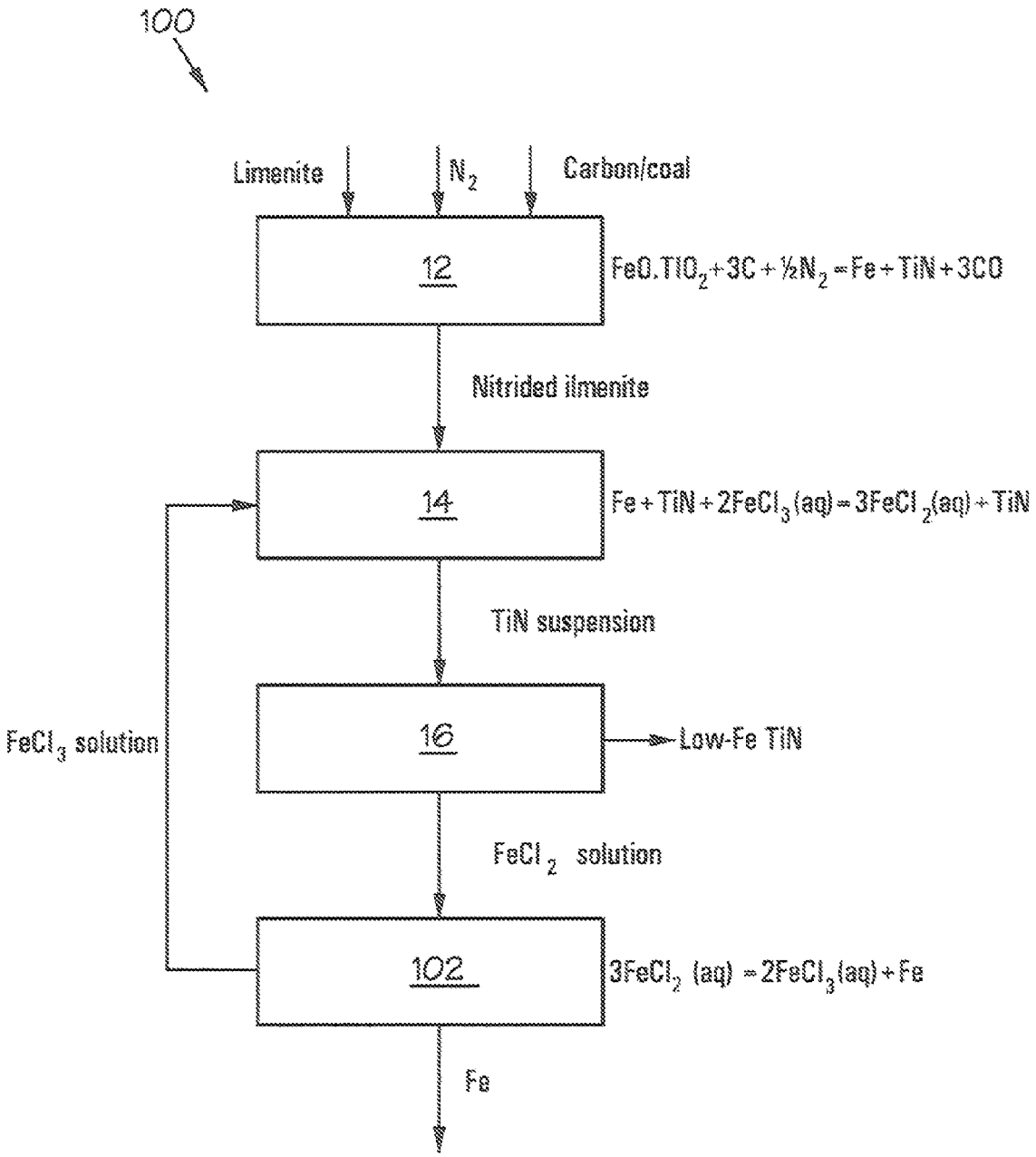

The invention will now be described, by way of example, with reference to the accompanying diagrammatic drawings in which FIG. 1 shows a flowsheet of one embodiment of a method in accordance with the invention of upgrading a titaniferous material; and FIG. 2 shows a flowsheet of another embodiment of a method in accordance with the invention of upgrading a titaniferous material.

Referring to FIG. 1 of the drawings, reference numeral 10 generally indicates a method of upgrading a titaniferous material. The method 10 includes a nitriding step 12, an iron oxidation step 14, an $Fe^{2+}$ ions removal step 16, an $Fe^{2+}$ oxidation step 18 and an $Fe_2O_3$ filtration step 20.

The method 10 is used to treat ilmenite, with a theoretic composition of $FeO.TiO_2$, to provide a low-Fe TiN product. Ilmenite, nitrogen and a carbon-containing material, e.g. coal, are fed to the nitriding step 12 where the FeO is reduced to iron metal and the $TiO_2$ is nitrided to TiN. This is typically effected in a large refractory-lined kiln operated at a temperature of about 1300° C. The kiln produces a carbo-nitrided intermediate which includes TiN and Fe which is fed to the iron oxidation step 14. Carbon monoxide as an off-gas is produced by the nitriding step 12, in accordance with reaction (3)

$$FeO.TiO_2+3C+\tfrac{1}{2}N_2=Fe+TiN+3CO. \quad (3)$$

In the iron oxidation step 14, the carbo-nitrided intermediate comprising TiN and Fe is leached with an aqueous solution of $FeCl_3$ as lixivant. Substantially all of the iron is converted to ferrous chloride ($FeCl_2$) in accordance with reaction (4)

$$Fe+TiN+2FeCl_3(aq)=3FeCl_2(aq)+TiN \quad (4)$$

The ferric chloride solution may be at a temperature of about 80° C. Surprisingly, substantially none of the TiN is oxidised by the ferric chloride but substantially all of the iron present is converted to ferrous ions. In order for the method of the invention to work efficiently, the ferric ions must be in the form of a water-soluble salt and the corresponding ferrous salt must also be water-soluble. Chlorides are the preferred salts because of the high solubility of both $FeCl_3$ and $FeCl_2$ in water, but there are also other salts, e.g. nitrates that are suitable. Sulphates are preferably not used because of the low solubility of ferric sulphate in water.

The next step of the method 10 requires removal of $Fe^{2+}$ ions from the carbo-nitrided intermediate subjected to ferric chloride leaching. This is typically effected by filtrating a suspension comprising the leached carbo-nitrided intermediate and the aqueous ferrous chloride solution, producing a low-Fe TiN product and a ferrous chloride solution stream. Typically, the low-Fe TiN product is dried. If it is desired to convert the TiN to $TiCl_4$, the TiN is chlorinated with chlorine in a chlorinator at a temperature of between about 170° C. and 250° C., e.g. about 200° C. This step is not shown in the drawings, but may for example be effected in accordance with the teachings of U.S. Pat. No. 6,423,291.

In order to regenerate $Fe^{3+}$ ions for use in the iron oxidation step 14, the ferrous chloride solution is oxidised in the $Fe^{2+}$ oxidation step 18, using air at about 1 to 2 bar(g) and 90° C. Depending on the temperature and oxidation potential at which this reaction is undertaken, it is possible to form different iron oxides such as FeO.OH, $Fe(OH)_3$ or $Fe_2O_3$. The chemistry of the formation of different iron oxides from ferrous chlorides is well documented and known to those skilled in the art and will not be discussed in any further detail.

In the embodiment of the method shown in FIG. 1, it is assumed that the $Fe^{2+}$ oxidation step 18 produces $Fe_2O_3$ in accordance with reaction (7)

$$6FeCl_2+1\tfrac{1}{2}O_2=4FeCl_3+Fe_2O_3 \quad (7)$$

The $Fe_2O_3$ is present in the form of a $Fe_2O_3$ suspension and the $Fe_2O_3$ is thus separated from the suspension to provide an $Fe_2O_3$ by-product and a ferric chloride solution, with the ferric chloride solution being recycled to the iron oxidation step 14. Typically, about ⅔ of the ferrous chloride entering the $Fe^{2+}$ oxidation step 18 is converted to ferric chloride and the balance forms part of the $Fe_2O_3$ by-product.

Referring to FIG. 2 of the drawings, another embodiment of a method in accordance with the invention to upgrade a titaniferous material is shown and indicated generally by reference numeral 100. The method 100 is similar to the method 10 and unless otherwise indicated, the same process steps or features are indicated by the same reference numerals.

As will be noted, instead of having a $Fe^{2+}$ oxidation step 18 and an $Fe_2O_3$ filtration step 20, the method 100 includes an Fe electrowinning step 102. The Fe electrowinning step 102 comprises an electrolytic cell in which the ferrous chloride solution from the $Fe^{2+}$ ions removal step 16 is electrolytically converted to a ferric chloride solution and iron, using reaction (11)

$$\text{overall electrochemical reaction } 3Fe^{2+}=Fe+2Fe^{3+} \quad (11)$$

The method of the invention, as illustrated, shows a number of advantages compared to conventional processes of which the applicant is aware in which $TiO_2$, instead of TiN, is produced for subsequent chlorination to $TiCl_4$. $TiO_2$ is stable and the titanium cannot be oxidised any further. In contrast, TiN is in a reduced form and can readily be oxidised to titanium in the quaternary valence state. This is an important aspect in the selective chlorination of TiN versus the unselective carbo-chlorination of $TiO_2$. The method of the invention enables lower capital costs for chlorination reactors for the chlorination of TiN as compared to the chlorination reactors required for the chlorination of $TiO_2$. The method of the invention, as illustrated, provides lower consumption of chlorine and does not use relatively expensive petroleum coke, in contrast to conventional processes of which the applicant is aware that use petroleum coke as reactant. The method of the invention, as illustrated, also does not require roasting of ilmenite followed by magnetic separation of small amounts of low-grade impurities, as the method of the invention can accommodate these impurities. Furthermore, the method of the invention, as illustrated, allows lower grade titaniferous materials to be upgraded. In addition, any treatment of chlorinator off-gas when using the method of the invention, as illustrated, is simpler because the gas volume and gas temperature are significantly lower than for $TiO_2$ chlorinators, and the gas does not contain sublimed chlorides, such as $FeCl_3$. It is also expected that the method of the invention will provide lower $TiCl_3$ losses in off-gas from the chlorinators.

The invention claimed is:

1. A method of upgrading a titaniferous material, the method including nitriding and reducing a titaniferous material which includes $TiO_2$ and Fe oxides in the presence of nitrogen and carbon to convert the $TiO_2$ to TiN and to reduce the Fe oxides to Fe, the TiN and Fe obtained from the nitriding and reduction of the titaniferous material being in the form of a carbo-nitrided intermediate which includes TiN and Fe;

oxidising the Fe in preference to the TiN to form $Fe^{2+}$ ions, the oxidation of the Fe in preference to the TiN including reacting the carbo-nitrided intermediate which includes TiN and Fe with a $FeCl_3$ solution in accordance with reaction (4):

$$Fe+TiN+2FeCl_3(aq)=3FeCl_2(aq)+TiN \quad (4)$$

and removing the $Fe^{2+}$ ions to produce an upgraded low-Fe TiN bearing material.

2. The method as claimed in claim 1, which includes chlorinating the upgraded low-Fe TiN bearing material thereby converting the TiN therein to $TiCl_4$ in accordance with reaction (1):

$$TiN+2Cl_2=TiCl_4+\tfrac{1}{2}N_2. \quad (1)$$

3. The method as claimed in claim 1, wherein the titaniferous material is ilmenite in which the $TiO_2$ is present as $FeO.TiO_2$, with the $FeO.TiO_2$ being nitrided carbothermically to provide TiN and metallic Fe and one or more carbon oxides.

4. The method as claimed in claim 1, wherein reaction (4) is carried out at an elevated temperature between ambient temperature and the boiling point of the ferric chloride solution ($FeCl_3(aq)$), to enhance the rate of reaction between the $Fe^{3+}$ ions and the Fe and to increase the solubility of both ferric chloride and ferrous chloride.

5. The method as claimed in claim 1, wherein during the nitriding and reducing of the titaniferous material, all of the Fe oxide is reduced to metallic iron, with the iron being in the form of small particles that are intimately mixed with small TiN particles that are sintered together in the carbo-nitrided intermediate which includes TiN and Fe, thereby allowing extraction of the iron from the carbo-nitrided intermediate as $Fe^{2+}$ using $FeCl_3$ in accordance with reaction (4) above.

6. The method as claimed in claim 5, which includes the step of regenerating $Fe^{3+}$ ions from the ferrous chloride solution ($FeCl_2(aq)$) obtained by reacting the carbo-nitrided intermediate with the ferric chloride solution ($FeCl_3(aq)$).

7. The method as claimed in claim 6, in which only a portion of the ferrous chloride is converted to $Fe^{3+}$ ions, the balance being in the form of a by-product efthe method containing iron in a non-chloride form.

8. The method as claimed in claim 7, wherein the regenerated $Fe^{3+}$ ions are recycled for reuse to oxidise the Fe in preference to the TiN to form $Fe^{2+}$ ions.

9. The method as claimed in claim 6, wherein regeneration of the $Fe^{3+}$ ions includes oxidation of the ferrous chloride with oxygen according to reactions (7) and (8):

$$6FeCl_2(aq)+1\tfrac{1}{2}O_2=4FeCl_3(aq)+Fe_2O_3 \quad (7)$$

$$6FeCl_2(aq)+1\tfrac{1}{2}O_2+H_2O=2FeO.OH+4FeCl_3(aq). \quad (8)$$

10. The method as claimed in claim 6, wherein regeneration of the $Fe^{3+}$ ions includes the electrochemical oxidation of the ferrous chloride in a cell to produce ferric chloride at an anode of the cell and electrolytic iron at a cathode of the cell, with the electrochemical reactions to regenerate ferric chloride and to electrowin iron being in accordance with reactions (9), (10) and (11):

cathode reaction $Fe^{2+}+2e^{-}=Fe$ (9)

anode reaction $2Fe^{2+}=2Fe^{3+}+2e^{-}$ (10)

overall electrochemical reaction $3Fe^{2+}=Fe+2Fe^{3+}$. (11)

11. The method as claimed in claim 1, wherein removal of the $Fe^{2+}$ ions to produce the upgraded low-Fe TiN bearing material includes separation of $Fe^{2+}$ solution from any unreacted carbo-nitrided intermediate to produce the upgraded low-Fe TiN bearing material and a $Fe^{2+}$ solution.

12. The method as claimed in claim 11, wherein the separation comprises a physical separation step, followed by washing the low-Fe TiN bearing material with an aqueous fluid.

13. The method as claimed in claim 12, which includes drying the upgraded low-Fe TiN bearing material.

* * * * *

UNITED STATES PATENT AND TRADEMARK OFFICE

CERTIFICATE OF CORRECTION

PATENT NO. : 9,017,625 B2
APPLICATION NO. : 13/993305
DATED : April 28, 2015
INVENTOR(S) : Van Vuuren et al.

It is certified that error appears in the above-identified patent and that said Letters Patent is hereby corrected as shown below:

In the Claims:

In Claim 3, Column 6, line 34:

Replace:

$FeO.TiO_2$, with the $FeO.TiO_2$ being nitride—

With:

$FeO{\bullet}TiO_2$, with the $FeO{\bullet}TiO_2$ being nitride—

In Claim 7, Column 6, Line 57:

Remove:

efthe method

In Claim 9, Column 6, line 34:

Replace Reaction 8 with:

$6FeCl_2(aq) + 1\frac{1}{2}O_2 + H_2O = 2FeO{\bullet}OH + 4FeCl_3(aq)$.

Signed and Sealed this
Eighth Day of September, 2015

Michelle K. Lee

Michelle K. Lee
*Director of the United States Patent and Trademark Office*